US007230884B2

(12) United States Patent
Shemesh

(10) Patent No.: US 7,230,884 B2
(45) Date of Patent: Jun. 12, 2007

(54) CLOCK DIAGNOSTICS

(75) Inventor: Ilan Shemesh, Newtown, PA (US)

(73) Assignee: The Sapling Company, Inc., Huntingdon Valley, PA (US)

( * ) Notice: Subject to any disclaimer, the term of this patent is extended or adjusted under 35 U.S.C. 154(b) by 269 days.

(21) Appl. No.: 10/751,575

(22) Filed: Jan. 5, 2004

(65) Prior Publication Data

US 2004/0167739 A1 Aug. 26, 2004

Related U.S. Application Data

(60) Provisional application No. 60/438,049, filed on Jan. 3, 2003.

(51) Int. Cl.
*G04C 13/08* (2006.01)

(52) U.S. Cl. ..... 368/46; 368/59

(58) Field of Classification Search ..... 368/46, 368/47, 59, 60; 340/539.24; 702/193; 714/26, 714/712, 713
See application file for complete search history.

(56) References Cited

U.S. PATENT DOCUMENTS

| | | | | |
|---|---|---|---|---|
| 4,582,434 | A * | 4/1986 | Plangger et al. | 368/46 |
| 6,323,783 | B1 * | 11/2001 | Lizzi et al. | 340/5.1 |
| 6,751,164 | B1 * | 6/2004 | Sekiguchi | 368/80 |
| 7,047,293 | B2 * | 5/2006 | Motoyama et al. | 709/224 |
| 2004/0165480 | A1 * | 8/2004 | Shemesh et al. | 368/46 |

* cited by examiner

*Primary Examiner*—Ren Yan
(74) *Attorney, Agent, or Firm*—Lucas & Mercanti, LLP

(57) ABSTRACT

Disclosed is a clock for use in a master/slave clock system, including a system and method for semi-automatically performing diagnostic self-tests on the status and operability of a plurality of components of one or more secondary clocks. The invention addresses a multitude of diagnostic and problem detection issues, including "no fault found."

2 Claims, 8 Drawing Sheets

CLOCK DIAGNOSTICS

CROSS-REFERENCE TO RELATED APPLICATION

This application is entitled to the benefit of U.S. Provisional Patent Application Ser. No. 60/438,049, filed Jan. 3, 2003. Such application is incorporated herein by reference.

FEDERALLY SPONSORED RESEARCH

Not Applicable

SEQUENCE LISTING OR PROGRAM

Not Applicable

BACKGROUND OF THE INVENTION

The present invention pertains to diagnostic systems for timekeeping systems, and more particularly to diagnostic systems for master/slave clock systems, commonly used in schools, hospitals, offices and industrial applications.

Many timekeeping systems are comprised of a master clock driving or communicating with one or more "slave" or secondary clocks that are periodically updated to be time synchronous to the master. Older systems did not have the benefit of microprocessor technology, as do units produced today. In modern systems, both the master and secondary clocks frequently contain microprocessors, and it is advantageous to utilize this intelligence. Secondary clocks in these systems may have either the traditional analog face or a digital display, or both.

It is known in the prior art to employ diagnostic systems to detect errors or problems in some office machines. For example, many office machines today such as copiers employ diagnostic systems to detect local errors such as a "paper jam" condition, a "paper low" condition, etc. Some prior art clock systems have also shown simple means in the master clock that is limited to forcing secondary clock hands to a known position. However, no automatic or semi-automatic diagnostic electronics for performing a plurality of diagnostic self-tests at the secondary clock is known to be included in secondary clocks as described by the prior art.

Currently during system installation and debug for timekeeping systems, there are no tools available that address the need for on-location diagnostics. Problems can occur not only with protocol selection at the secondary clocks, but also with transmitted data integrity, faulty secondary clock electronics and mechanisms, incompatible software revisions, clock hand position/digital display calibration, and other matters.

SUMMARY OF THE INVENTION

To overcome the disadvantages of the prior art, disclosed is a semi-automatic system and method for the design and operation of secondary clocks in a master/slave clock system, which addresses a multitude of diagnostic, and problem detection issues, including "no fault found."

More particularly, in one embodiment, the invention comprises:

a slave clock configured to be coupled to a master clock; and means within the slave clock for initiating and performing semi-automatic diagnostic tests on current status and operability of components of the slave clock upon activation of a control device, and to display results of the diagnostic tests via a display device at the slave clock.

In a preferred embodiment, the control device of the present invention is an operator-activated device, such as a switch, that may be located either at the slave clock or at the master clock.

In another embodiment, the invention comprises:

a slave clock configured to be coupled to a master clock;

means within each slave clock for activating a diagnostics mode and for initiating and performing semi-automatic diagnostic tests on current status and operability of components of the slave clock upon activation of a control device, and to display results of the diagnostic tests via a display device at the slave clock; and means for optionally deactivating the diagnostics mode and for returning the slave clock to a normal clock mode.

In another embodiment, the invention comprises:

a slave clock configured to be coupled to a master clock, and for receiving data from the master clock using a communication protocol; and means within the slave clock for determining and displaying at the slave clock the communication protocol currently in use by the slave clock.

In another embodiment, the invention comprises:

a slave clock configured to be coupled to a master clock, and for receiving data from the master clock using a communication protocol; and means within the slave clock for determining and displaying at the slave clock the amount of time that has passed since data was received by the slave clock from the master clock.

In another embodiment, the invention comprises:

an analog slave clock including display hands driven by at least one stepper motor coupled to the hands by gears, the slave clock further configured to be coupled to a master clock; and means within the slave clock for initiating and performing a diagnostic test to determine operability of the gears and motor upon activation of a control device, and to display results of the diagnostic test via a display device at the slave clock.

In another embodiment, the invention comprises a master/slave clock system, comprising:

a master clock coupled to at least one slave clock, the master clock located remotely from the at least one slave clock; and means within the master clock for initiating and performing semi-automatic diagnostic tests on current status and operability of components of the at least one slave clock upon activation of a control device at the master clock by an operator, and to display results of the diagnostic tests via a display device.

In another embodiment, the invention comprises a clock adapted for use in a master/slave clock system and including means to perform semi-automatic diagnostic tests on slave clock components, comprising:

at least one slave clock configured to be coupled to a remote master clock;

a processing unit and a memory at the slave clock, the processing unit operating under software control, the processing unit configured to control slave clock functions;

whereby the processing unit is further configured to initiate and perform diagnostic tests on current status and operability of components of the slave clock upon activation of a control device, and to display results of the diagnostic tests via a display device at the slave clock.

In another embodiment, the invention comprises a slave clock adapted for use in a master/slave clock system, comprising:

at least one slave clock configured to be coupled to a master clock;

a processing unit and a memory at the slave clock, the processing unit operating under software control, the processing unit configured to control slave clock functions;

whereby the processing unit is further configured to initiate and perform a diagnostic test to determine the operability of the memory upon activation of a control device, and to display a result of the diagnostic test via a display device at the slave clock.

In another embodiment, the invention comprises a system and method in which at least three different series of diagnostic tests may be initiated by an operator at either a slave clock or a master clock, each series being selected by activating a control device a predetermined number of times within a predetermined time interval.

In another embodiment, the invention comprises a system and method for initiating and executing a plurality of diagnostic tests on components of a slave clock in a master/slave clock system, the tests including one or more of the following: determination of communication protocol type used by the slave clock, determination of ability to receive data from the master clock, determination of motor and drive gear operability, determination of current software version in use by the slave clock, determination of presence or absence of electrical power from a power supply, determination of whether a signal is being received from an optoswitch at the slave clock, determination of whether data can be properly read into- and out of the memory at the slave clock, and determination of how much time has passed since the slave clock received communication from the master clock.

In one embodiment, results of the diagnostic tests are communicated to an operator by way of predetermined numbers of flashes of a visual indicator within a predetermined time interval.

In another embodiment, the invention comprises a method of performing a plurality of diagnostic tests of components of a slave clock of a master/slave clock system, comprising the steps of:

(a) determining which diagnostic tests have been selected by an operator-activated control device to be performed at the slave clock (b) automatically performing the diagnostic tests selected by an operator to determine current status and operating condition of a plurality of components of the slave clock; and (c) automatically communicating results of the diagnostic tests to the operator by a display device.

BRIEF DESCRIPTION OF THE DRAWINGS

These and other features and advantages of the invention will now be described with reference to the drawings of certain preferred embodiments, which are intended to illustrate and not to limit the invention, and in which like reference numbers represent corresponding parts throughout, and in which.

DETAILED DESCRIPTION OF THE INVENTION

Summary of Features

Some of the significant features of a preferred embodiment of the present invention may be summarized as follows:

First, the secondary or "slave" clocks of a timekeeping system (see FIGS. 1 and 2) include the diagnostic capability to display via a visual or other indicator, such as an LED display or hand position, the current status of the secondary clock with regard to communication protocol type, ability to receive data, and indicate normal/abnormal internal clock functions. In a preferred embodiment, the number, duration and color of light flashes from the LED indicates the type of problem or other condition detected.

Second, the secondary clocks include the diagnostic capability to initiate one or more self-tests via a pushbutton or other operator-activated device on the secondary clock body.

Third, the secondary clocks include a capability to receive commands from a remote location (e.g., a master clock) to perform self-diagnostics. This remote location can also command all secondary clocks to move back to display times (i.e., return to normal clock mode) after the diagnostic test(s) have been completed.

Fourth, the secondary clocks include the diagnostic capability to analyze motor and drive gear operation via gear box sensors. A visual or other indicator is included at or near the slave clock gear box to indicate normal/abnormal conditions.

Fifth, the secondary clocks include the diagnostic capability to display the current software revision of the secondary clock software on the secondary clock display face.

Sixth, the secondary clocks include the capability to display certain aspects of the operational history of the secondary clocks, such as how much time has passed since the secondary clocks have received time data or other communications from the master clock.

The types of problems and conditions that are detectable by the present invention include, but are not limited to: stuck, dirty or broken gears or stepper motors; presence or absence of a signal from the optical switch (discussed below); presence or absence of a 50 Hz or 60 Hz AC signal; faulty power supply; and others. An operator is able to manually select a plurality of diagnostic tests to be run on the secondary clock by, for example, pushing a switch on the secondary clock a certain number of times within a certain time period. A system of multiple secondary clocks connected to a master clock can also be commanded at the master clock to cause all secondary clocks to enter into diagnostics mode and execute diagnostic tests, and then to return to normal clock mode at the end of the diagnostic tests.

System Description and Method of Operations

Figure 1:
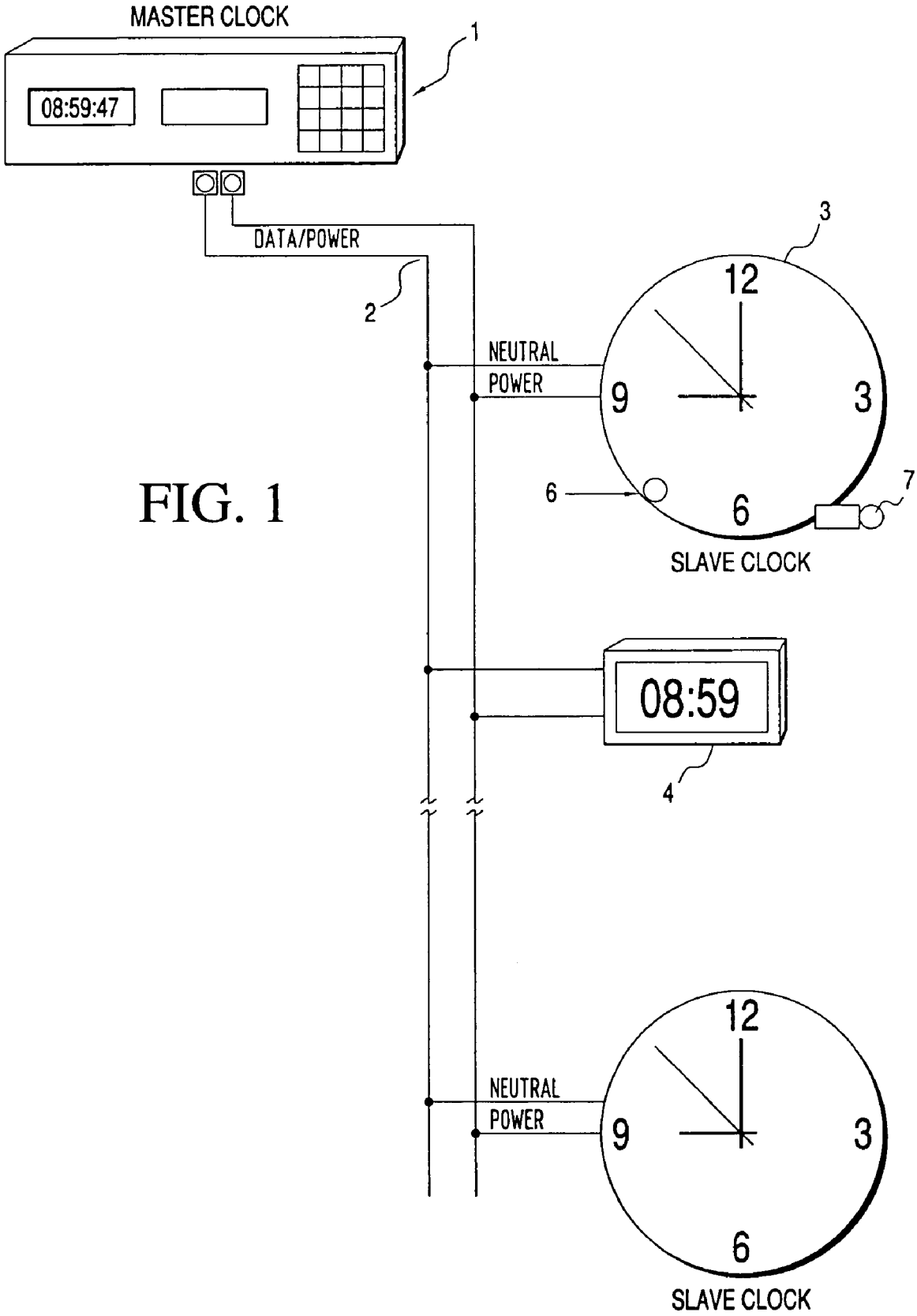
FIG. 1 is an overall block diagram of an embodiment of a two-wire timekeeping system of the present invention having master and secondary (slave) clocks.

Turning now to the drawings, FIG. 1 shows an overall block diagram of a preferred embodiment of a two-wire timekeeping system of the invention, with master clock 1 connected to secondary clocks 3 and 4. The secondary clocks may have analog or digital displays, or both. The master clock sends data to the secondary clocks over a bus 2. A pushbutton, switch or other operator-activated control device 7 on the analog clock is used to initiate installation and diagnostic (debug) processes. An optional operator-activated switch or other control device (not shown) at the master clock may also be included to permit an operator at the master clock to cause all slave clocks to enter diagnostic mode, and then return the slave clocks to normal clock mode at the conclusion of diagnostic testing. One or more light-emitting diodes (LEDs) or other indicator devices 6 at the slave clock are shown for communication to installation personnel of clock status and fault codes. Different colors or other display attributes for the devices 6 may be used to indicate different types of faults, results of different diagnostic tests, or different aspects of clock status or operational history.

Figure 2:
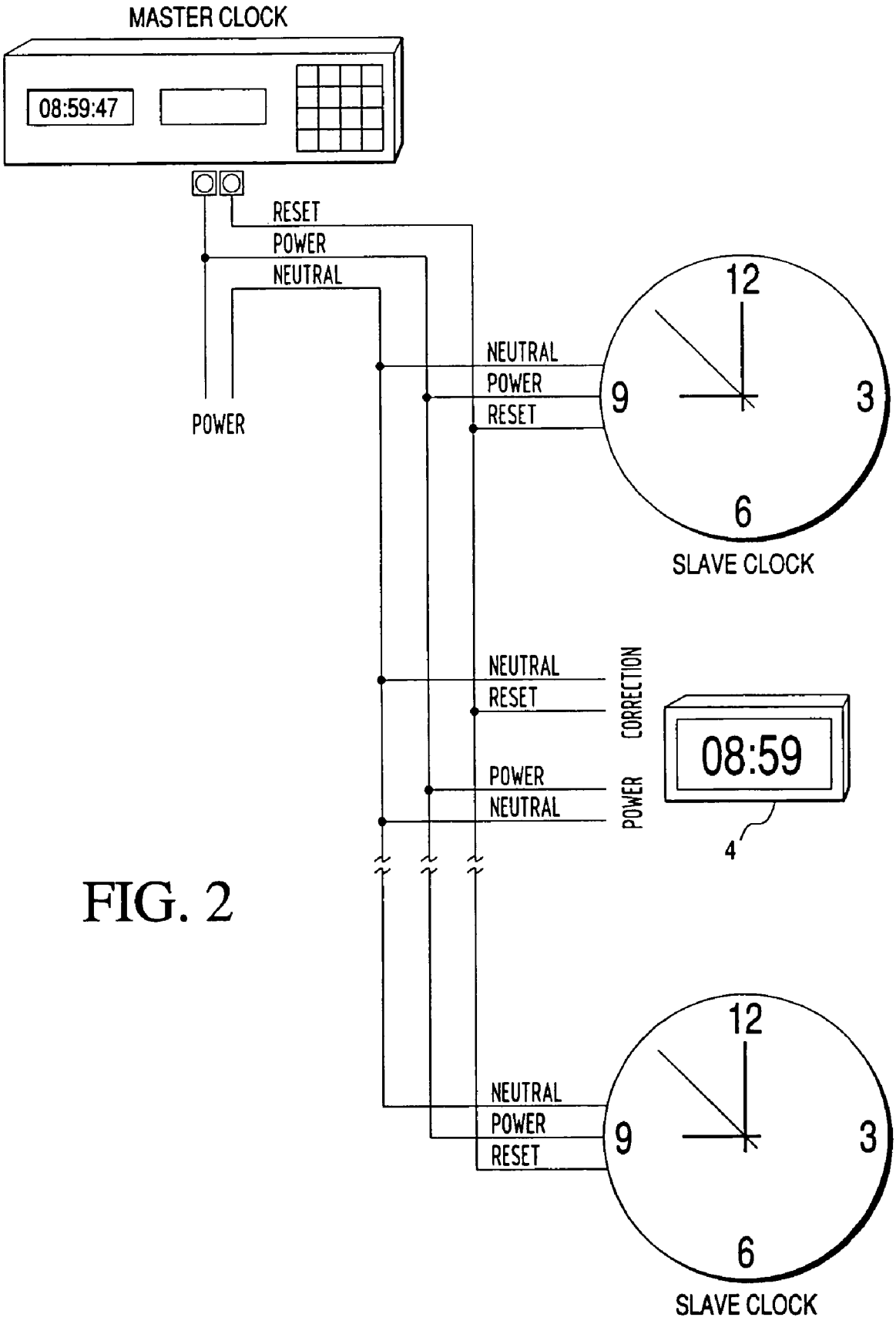
FIG. 2 is an overall block diagram of an embodiment of a three-wire timekeeping system of the present invention having master and secondary (slave) clocks.

FIG. 2 is an overall block diagram of an embodiment of a three-wire timekeeping system of the present invention having master and secondary (slave) clocks. A variety of communication protocols may be employed.

Figure 3:
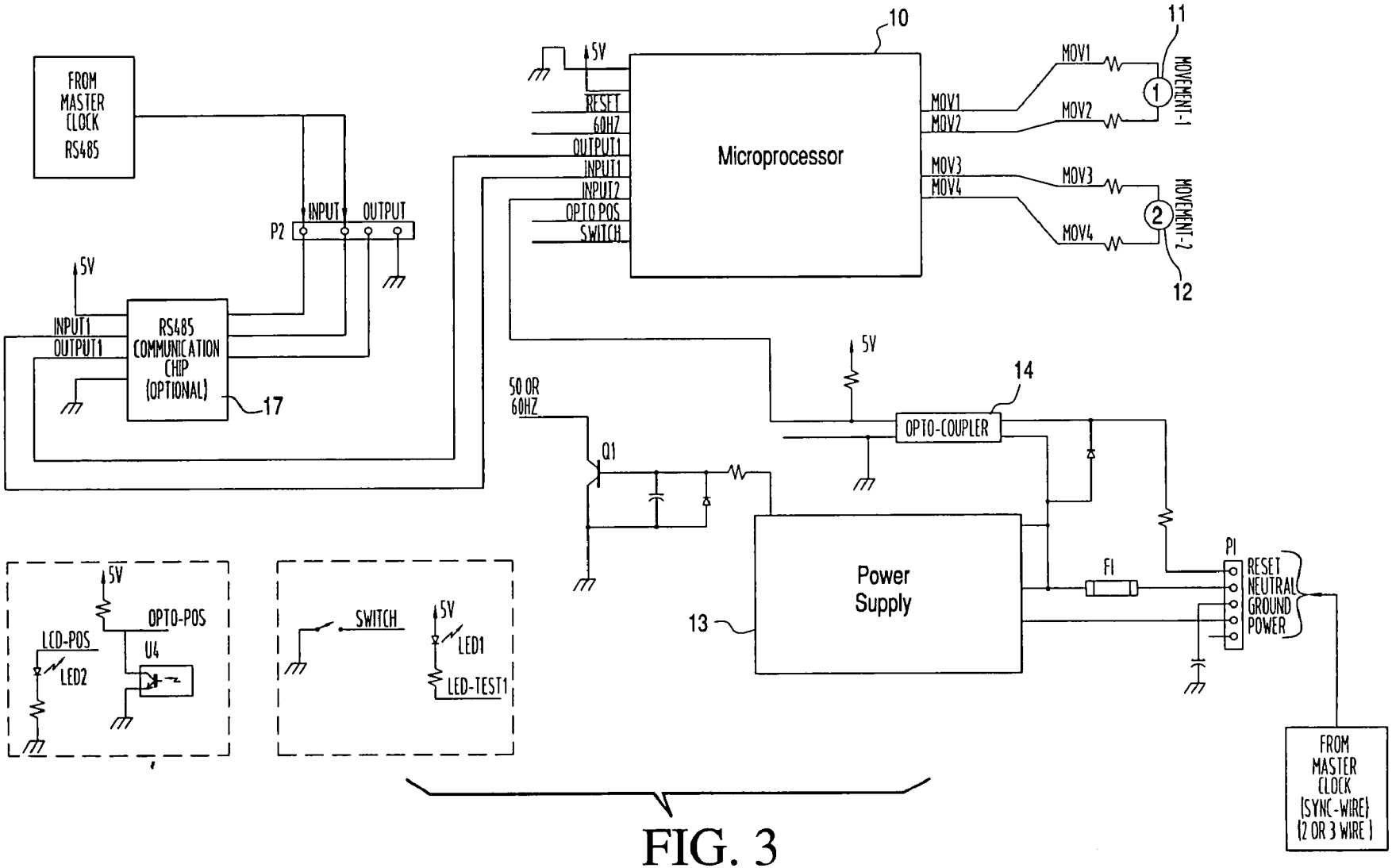
FIG. 3 is a combined block and electrical schematic diagram of one embodiment of a slave clock of the invention.

FIG. 3 shows a combined block and electrical schematic diagram of one embodiment of an analog slave clock of the invention. Processing is handled by a microprocessor or other processing unit 10 running microcode or other software stored in an internal memory at the slave clock, or executing hard-wired operations. Preferably, microprocessor 10 includes a program memory, RAM, and EEPROM for data storage. The microprocessor may also include a crystal oscillator or an RC oscillator circuit. In a preferred embodiment, microprocessor 10 may comprise model ST7FLITE2, manufactured by ST Microelectronics. A stepper motor 11 ("Movement_1") drives the second hand, and a stepper motor 12 ("Movement_2") drives the hour and minute hands. Connector P2 provides a connection to a master clock for receiving RS485 data that is communicated via INPUT1 via an optional RS485 communication chip 17 to the microprocessor. Transistor Q1 assists in determining the 60 Hz or 50 Hz time base, and in receiving binary data using two-wire digital communication. Opto-coupler 14 provides binary data or AC or DC pulses from the master clock from a "Reset" pin at terminal P1 to the microprocessor via an "INPUT2" connection. Microprocessor 10 may be programmed and re-programmed from the "outside world" through other terminals and connections (not shown).

Figure 4:
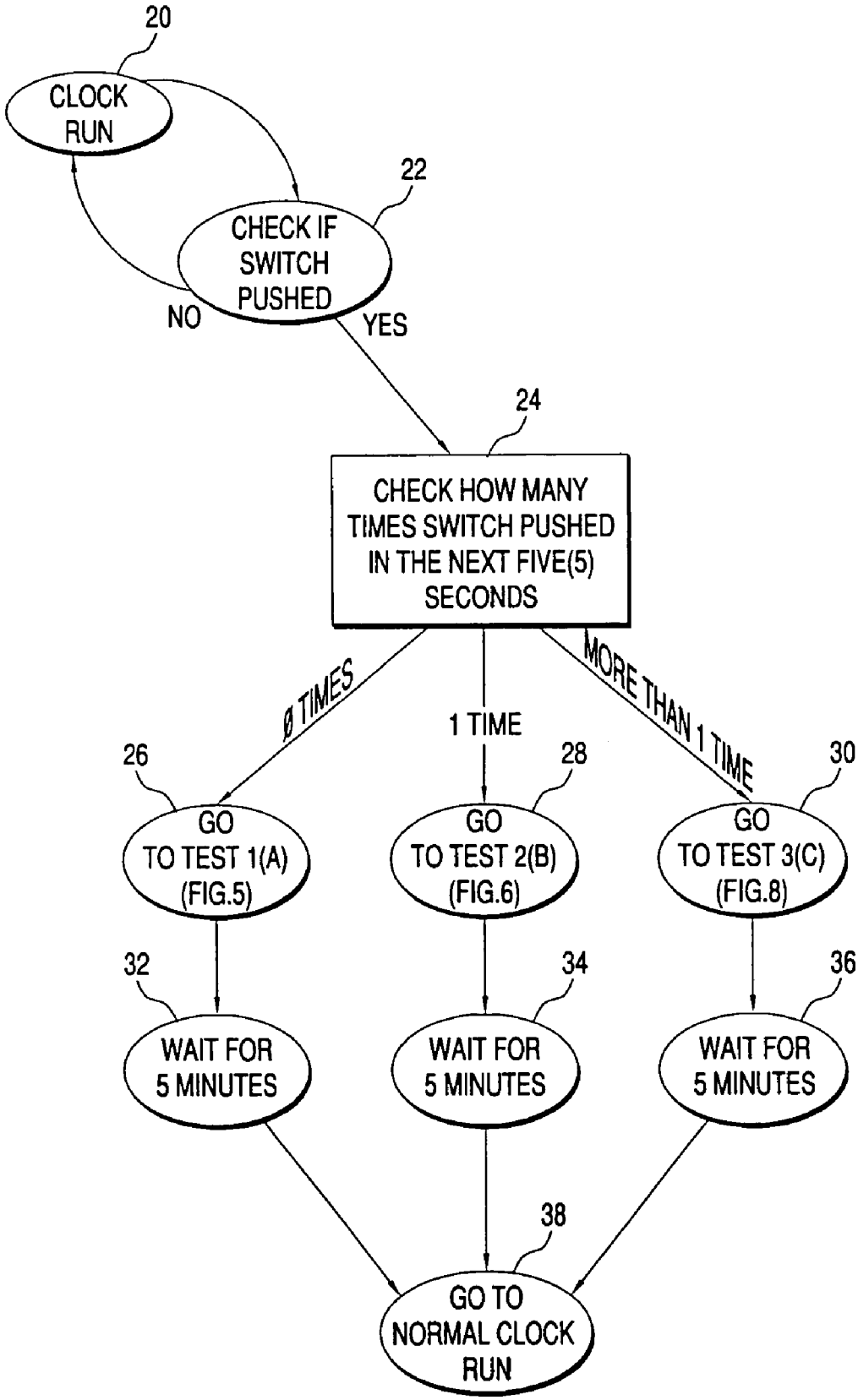
FIG. 4 is a flowchart showing the sequence of operations in one embodiment of the slave clock for determining an initial sequence of operations for determining tests.
Figure 5:
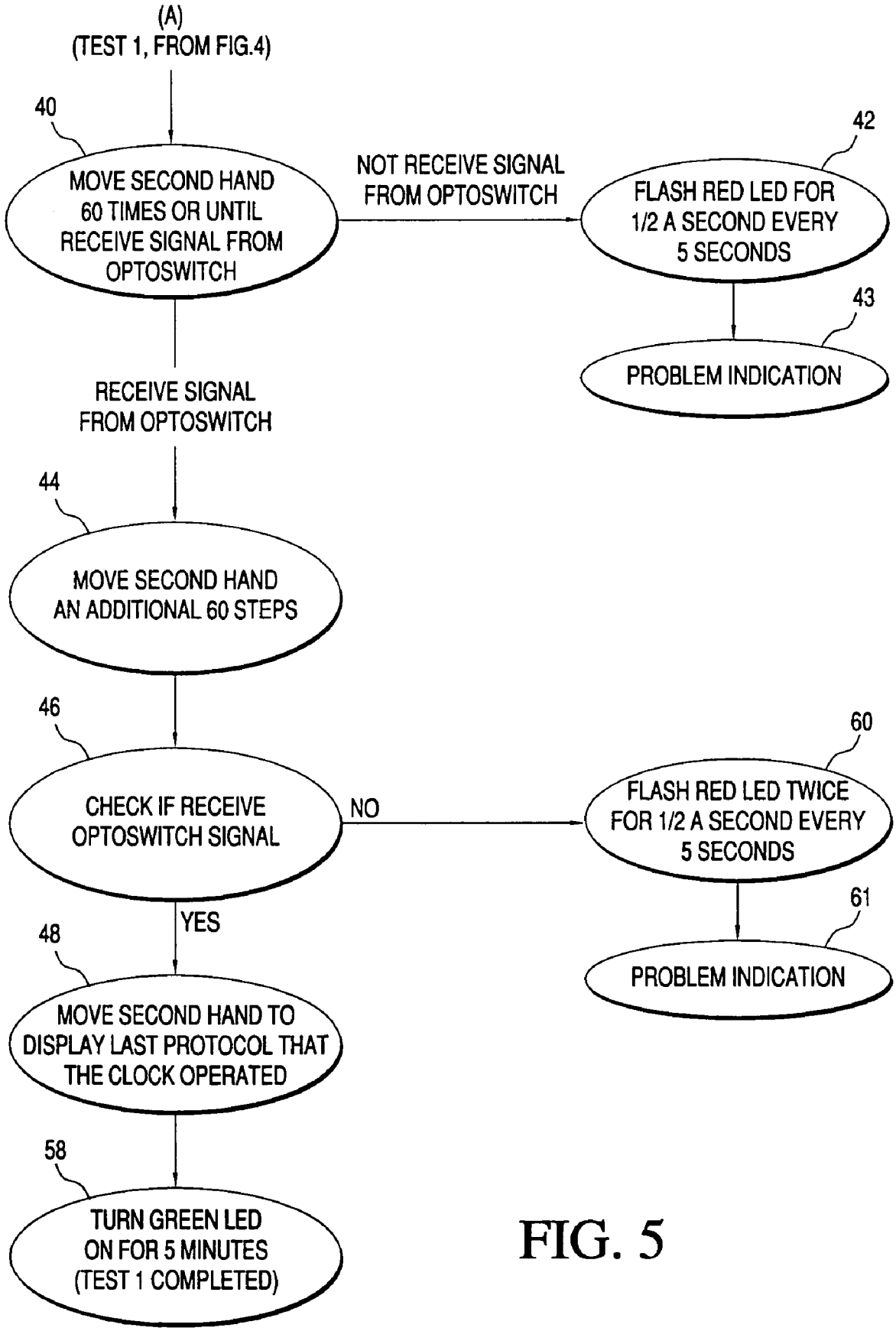
FIG. 5 is a flowchart showing the sequence of operations in one embodiment of the slave clock for performing a first diagnostic test.
Figure 6:
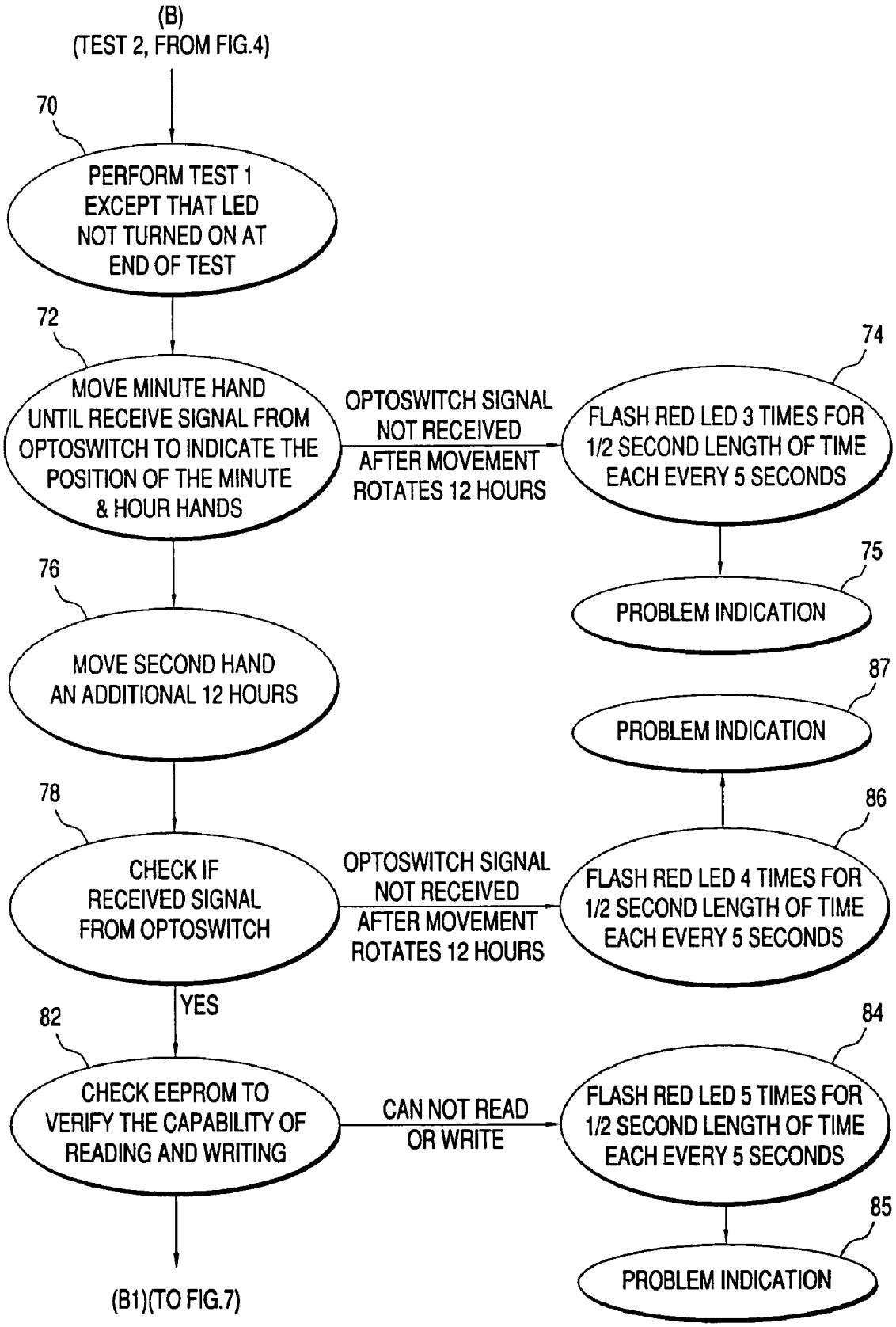
FIGS. 6–7, taken together, show a flowchart showing the sequence of operations in one embodiment of the slave clock for performing a second diagnostic test.
Figure 8:
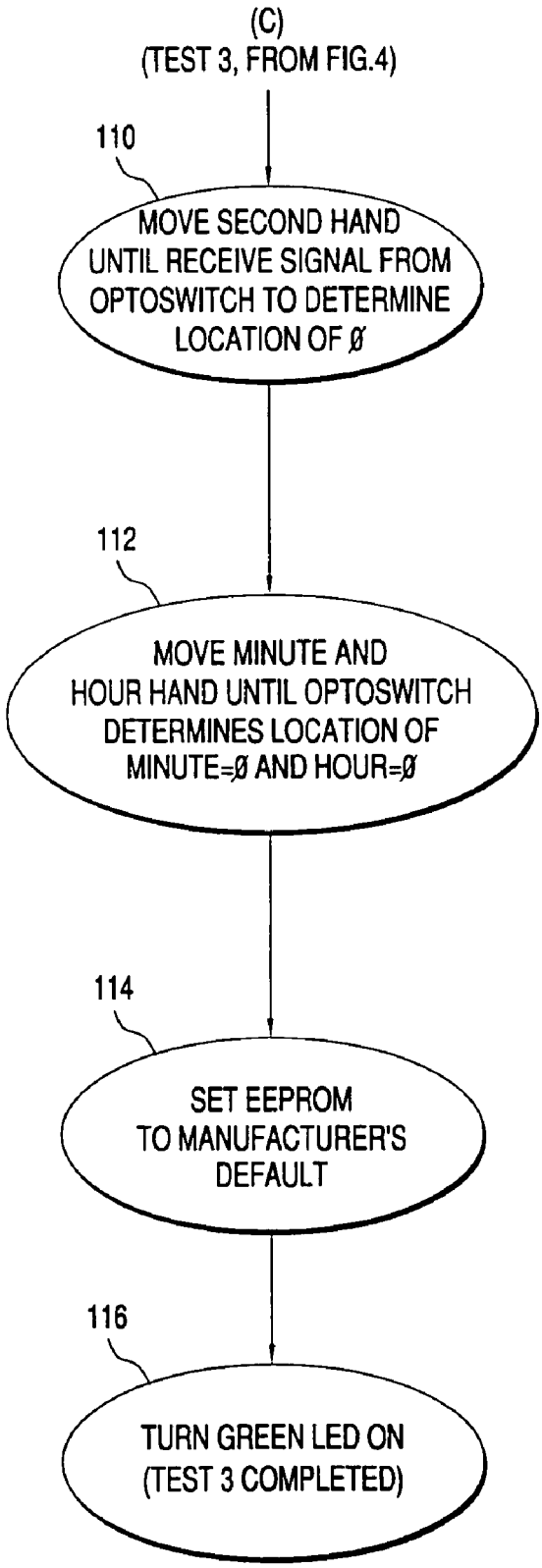
FIG. 8 is a flowchart showing the sequence of operations in one embodiment of the slave clock for performing a third diagnostic test.

FIG. 4 is a flowchart showing a sequence of operations in one embodiment of the slave clock for determining an initial sequence of operations for determining diagnostic tests. Normal clock run is shown at step 20. At step 22, a diagnostic switch or other control device (element 7 in FIG. 1) is checked to see if it has been pushed or otherwise activated. If not, processing returns to step 20. If so, the system (microprocessor 10 running microcode in a program memory) checks at step 24 to see how many times the switch or control device has been pushed in the next 5 seconds. If 0 times, processing goes to test 1 at step 26 (FIG. 5). If 1 time, processing goes to test 2 at step 28 (FIG. 6). If more than 1 time processing goes to test 3 at step 30 (FIG. 8).

FIG. 5 is a flowchart showing a sequence of operations in one embodiment of the slave clock for performing a first diagnostic test, called test 1. Here, continuing from FIG. 4, at step 40, the system moves the secondary clock's second hand 60 "ticks" or until a "receive signal" is received from an optoswitch (not shown) that is mounted adjacent to or near drive gears in the secondary clock housing. If a signal has not been received, then an LED or other indicator device 6 (see FIG. 1) of a first color, such as red, is flashed for ½ second every 5 seconds at step 42, which indicates to the operator that a problem has been detected and indicated (step 43). Some of the problems that can be detected include: whether the second hand is stuck; whether the gears are stuck; whether the motor has a problem; whether the optoswitch is not working; and others. If a signal has been received by the optoswitch at step 40, then the second hands are moved an additional 60 "ticks" at step 44. Then the system checks again to see if an optoswitch signal has been received. If not, then the red LED is flashed twice for ½ second every 5 seconds at step 60, which indicates a problem at step 61. If an optoswitch signal has been received at step 46, then the second hand is moved at step 48 to display the last protocol that the clock operated under. Then, at step 58, an LED or other indicator of a second color, such as green, is turned on for 5 minutes, to indicate the completion of diagnostic test 1. At the end of the five minutes delay, the clock will go to normal clock mode.

Figure 7:
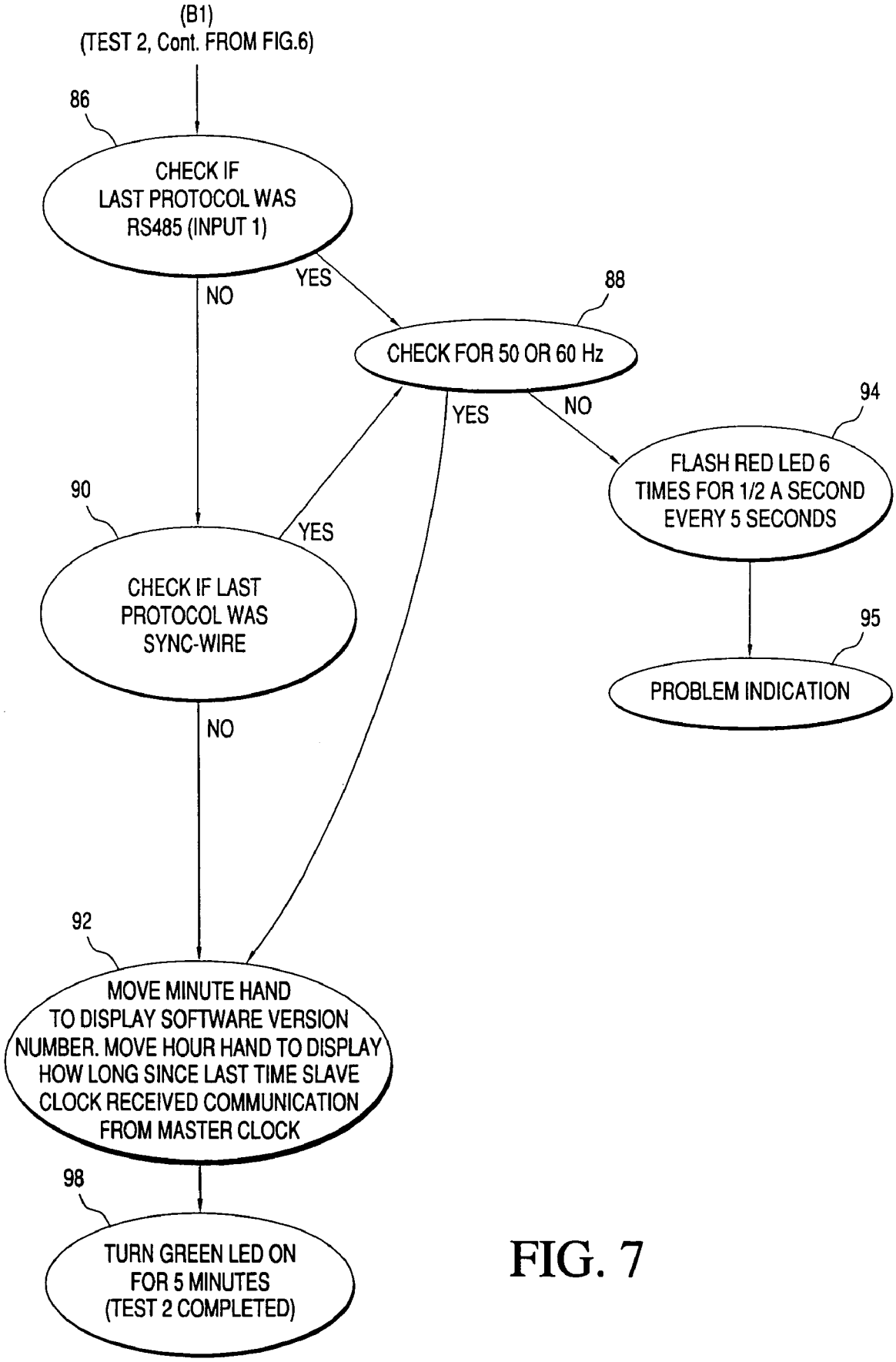

FIGS. 6–7, taken together, show a flowchart showing a sequence of operations in one embodiment of the slave clock for performing a second diagnostic test, test 2. Here, at step 70, coming from FIG. 4, the system again performs test 1, except that the LED 6 is not turned on at the end of the test. At step 72, the minute hand is moved until it receives a signal from the optoswitch to indicate the position of the minute and hour hands. If the optoswitch signal is not received after the movement rotates 12 hours, then the red LED is flashed 3 times for ½ second each every 5 seconds at step 74, and a problem is indicated at step 75.

Continuing with FIG. 6, at step 76, the minute hand is moved an additional 12 hours. At step 78, the system again checks to see if a signal has been received from the optoswitch. If not, processing proceeds to step 86 and the red LED is flashed 4 times for ½ second each every 5 seconds, to indicate a problem at step 87. If an optoswitch signal has been received, the system at step 82 then checks the EEPROM (or other memory) at the slave clock to verify that data can be properly read into and out of the EEPROM. If the system determines that it cannot read or write at step 82, then the red LED is flashed 5 times for ½ second each every 5 seconds at step 84, and a memory problem is indicated at step 85.

Moving now to FIG. 7, if the EEPROM is found to be able to read and write at step 82, then at step 86, the system checks to see if the last protocol was RS485 at input 1 (see FIG. 3). If so, the system checks for a 50 Hz or 60 Hz AC signal at step 88. If not, the red LED is flashed 6 times for ½ second each every 5 seconds at step 94, and a problem is indicated at step 95. If the outcome of decision step 86 is negative, then the system checks at step 90 to see if the last protocol was sync-wire. If so, the system checks for a 50 Hz or 60 Hz signal at step 88. If no 50 Hz or 60 Hz signal is detected, the red LED flashes for 6 times for ½ seconds every 5 seconds at-step 94, and a problem is indicated at step 95. If 50 Hz or 60 Hz is detected at step 88, or if no sync-wire was previously detected at step 90, then processing proceeds to step 92, where the minute hand is moved to display the software version number currently in use by the secondary clock, and the hour hand is moved to display how much time has passed since the slave clock received communication from the master clock. If more than 11 hours have passed, the hour hand will only advance to 11. Then, the green LED is turned on at step 98 for 5 minutes to indicate the completion of the diagnostic test 2. At the end of the five minutes delay, the clock will go to normal clock mode.

In FIG. 8, diagnostic test 3 is performed on the secondary clock(s). Continuing from FIG. 4, processing goes to step 110, where the second hand is moved until it receives a signal from the optoswitch to determine the location of Ø. At step 1112, the minute hand and hour hand are moved until the optoswitch has determined the location of minute=Ø and hour=Ø. At step 114, the EEPROM or other memory in the microprocessor 10 (or located elsewhere at the slave clock) is set to manufacturer's default, which brings the secondary clock to standard factory default settings. Finally, at step 1116, the green LED is turned on permanently to show the completion of diagnostic test 3.

What is claimed is:

1. A clock comprising:

a slave clock including a microprocessor and adapted to be coupled to a master clock;

the microprocessor coupled to a memory, a manually-operable control device, a time display and a diagnostic indicator display;

the microprocessor further configured to receive commands from the master clock;

data and diagnostic software instructions stored in the memory, whereas, upon operation of the control device at the slave clock, or upon receipt of a command from the master clock, the instructions cause the microprocessor to enter a diagnostics mode, to execute semi-automatic diagnostic self-tests on current status and operability or inoperability of components and functions of the slave clock, to display results of the self-tests via the diagnostic indicator display, and to return the slave clock to a normal clock mode following completion of the self-tests;

the diagnostic self-tests including at least three of the following: determination of communication protocol type used by the slave clock, determination of an ability or inability of the slave clock to receive data from the master clock, determination of motor and drive gear operability or inoperability, determination of current software version in use by the slave clock, determination of presence or absence of electrical power from a power supply, determination of whether a signal is being received from an optical switch at the slave clock, determination of whether data can be properly read into and out of the memory at the slave clock, and determination of how much time has passed since the slave clock received a communication from the master clock.

2. A master/slave clock system comprising:

a master clock;

at least one slave clock including a microprocessor and coupled to the master clock;

the microprocessor coupled to a memory, a manually-operable control device, a time display and a diagnostic indicator display; and data and diagnostic software instructions stored in the memory;

whereas, upon operation of the control device at the slave clock or upon receipt by the slave clock of a command from the master clock, the instructions in the memory cause the microprocessor to enter a diagnostics mode, to execute semi-automatic diagnostic self-tests on current status and operability or inoperability of components and functions of the slave clock, to display results of the tests via the diagnostic indicator display, and to return the slave clock to a normal clock mode following completion of said self-tests;

said diagnostic self-tests including at least three of the following: determination of communication protocol type used by the slave clock, determination of an ability or inability of the slave clock to receive data from the master clock, determination of motor and drive gear operability or inoperability, determination of current software version in use by the slave clock, determination of presence or absence of electrical power from a power supply, determination of whether a signal is being received from an optical switch at the slave clock, determination of whether data can be properly read into and out of the memory at the slave clock, and determination of how much time has passed since the slave clock received a communication from the master clock.

* * * * *